US006010438A

United States Patent [19]

Fitzgerald

[11] Patent Number: 6,010,438

[45] Date of Patent: Jan. 4, 2000

[54] ADJUSTABLE ATHLETIC SHOE WEIGHT ASSEMBLY

[76] Inventor: Patrick M. Fitzgerald, 118 Wando Creek La., Wando, S.C. 29492

[21] Appl. No.: 09/288,414

[22] Filed: Apr. 8, 1999

[51] Int. Cl.[7] ..... A63B 21/06; A63B 23/04

[52] U.S. Cl. ..... 482/105; 36/132

[58] Field of Search ..... 482/105; 36/132, 36/136

[56] References Cited

U.S. PATENT DOCUMENTS

| | | | |
|---|---|---|---|
| 3,114,982 | 12/1963 | McGowan | 36/2.5 |
| 3,306,610 | 2/1967 | Biggs | 482/105 |
| 4,458,432 | 7/1984 | Stempski | 36/132 |
| 4,638,579 | 1/1987 | Gamm | 36/136 |
| 4,777,743 | 10/1988 | Roehrig, Jr. | 36/132 |
| 5,231,776 | 8/1993 | Wagner | 36/114 |
| 5,339,542 | 8/1994 | Kim | 36/7.2 |
| 5,728,032 | 3/1998 | Glass | 482/105 |

FOREIGN PATENT DOCUMENTS

| | | | |
|---|---|---|---|
| 2139103 | 11/1984 | United Kingdom | 482/105 |

*Primary Examiner*—John Mulcahy

*Attorney, Agent, or Firm*—Harleston Law Firm; Kathleen M. Harleston

[57] ABSTRACT

An adjustable, removable weight assembly for an athletic shoe, each weight assembly comprising: (a) one or two removable, unitary base weight plates, each base weight plate having a pre-determined weight of between about 0.1 and about five pounds, each base weight plate having a top face and a bottom face, a length of between about two and ten inches, and a width of between about one and five inches, each base weight plate comprising at least one attachment for removably attaching each base weight plate to an upper portion of the shoe; (b) up to twenty removable, unitary, stackable intermediate weight plates, each intermediate weight plate having an identical, pre-determined weight of between about 0.1 and about five pounds, each intermediate weight plate having a bottom face and a top face; (c) two removable cover plates or straps, one on the inner side of the shoe upper, and the other fitting on an outer side of the shoe upper; and (d) an instep/back strap attached to the two cover plates or cover straps, the strap fitting under a shoe instep or along the back of the shoe when the weight assembly is in use.

10 Claims, 8 Drawing Sheets

ADJUSTABLE ATHLETIC SHOE WEIGHT ASSEMBLY

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Technical Field

The present device relates to a weight assembly for athletic shoes, more particularly to an adjustable weight assembly for removable attachment to an athletic shoe upper.

2. Background Information

Athletes and others have used small weights of between one and thirty pounds for many years to build up muscles in the arms and legs. Ankle and leg weights have been available commercially for several decades.

Problems with currently available athletic shoe weights include: they are not removable or easy and quick to put on, increments of weight cannot easily be added or subtracted, and they often require permanent modification of the athletic shoe. The present adjustable, removable shoe weight assembly solves these and other problems. The weight plates of the present invention do not obstruct or interfere with the feet when they are in motion. Another advantage is that identical weights can be added to each shoe, or the user can add a succinct amount of additional weight to one shoe in the case where the muscle of one leg needs to be built up more than the other leg. With the present assembly, increments of weight are easy to put on and remove from the shoe, making progressive training possible. The user can start with a low amount of weight and gradually increase it as exercise or training progresses. This weight assembly can be used by different people in the same family with different weight requirements. For example, the present detachable weight assembly can be used by a man who works out with eight one pound weight plates on each foot, and then his wife, who jogs with four 0.5 pound weight plates on each foot. This shoe weight assembly is also useful for the lay person, professional athletes in training, or patients under a doctor's care who are undergoing physical therapy.

In general, conventional progressive weight training systems utilized for lower extremity strength training are of two basic types: stationary machines with resistance applied through the plane or around the axis of motion allowed by each specific machine, whether the machine is approached sitting, standing or lying down; or weights attached to the legs above the ankles, which allow for resisted movement through multiple planes and axes of movement simultaneously. The latter theoretically has a significant advantage in that human movement is not performed through a single plane or around a single axis of movement, but rather through multiple planes and axes simultaneously. In reality, this can present significant physical and physiological problems. Regardless of how well-fitting a weight cuff is, there remains significant slack around the weight. The slack generates inertia that is counter to the forces created by the movement being performed (called pistoning). Also, a weight cuff is bulky and can make coordinated movement difficult. More significantly, assuming these physical problems were to be overcome, the forces generated by a weight cuff are believed to be countered only by the musculature superior to (above) the knee. This can create a "dragging" effect, which is uncomfortable and generates a distractional force at the knee. This force further destabilizes the joint of the body which is the most inherently unstable and most often injured in athletic activity: the knee. The ill-effects of this distractional force are enhanced with fatigue, and can lead to inflammation and significant pain and injury. Therefore, as a viable weight training tool, it is believed that weight cuffs should be limited to non-weight bearing (open chain) exercise, and discouraged as a tool for activities such as walking, running, or jumping, particularly when those activities include changes in speed or direction.

The weight assembly of the present invention is attached to the body via the shoe in a manner that virtually eliminates pistoning. Due to its unique lay out, this shoe weight assembly minimizes the bulkiness associated with ankle weights. Significantly, any negative forces generated by the present shoe weight assembly are countered by the musculature superior and inferior to the knee because the present shoe weight assembly is attached below the ankle. This minimizes any dragging effect and eliminates distractional forces that can destabilize the knee and can lead to inflammation, pain, and injury. The type of co-contraction provided by the present assembly tends to stabilize the knee and activities such as walking, running, and jumping can be performed largely without the discomfort and increased risk of injury associated with conventional cuff weights.

With cuff weights, the cuff in use must be exchanged for a heavier cuff or additional cuffs must be added in order to increase weight. This further decreases their functional use. Due to the unique arrangement of the present assembly, weight can be increased or decreased quickly without a significant increase in the vertical or horizontal profile of the shoe. This maximizes functionality, while applying the positive benefits of progressive resistive exercise to athletic activities including walking, running and jumping. In addition, because each step generates greater forces of acceleration and deceleration, the musculature of the trunk and upper extremities must respond with greater force in order to maintain kinetic balance and produce coordinated movement. Therefore, the entire body is required to generate greater muscular activity, and the physiological demand on all muscles, tendons and ligaments is increased.

BRIEF SUMMARY OF THE INVENTION

The present invention is an adjustable, removable weight assembly for an athletic shoe, each weight assembly comprising:

(a) one or two removable, unitary base weight plates, each base weight plate having a pre-determined weight of between about 0.1 and about five pounds, each base weight plate having a top face and a bottom face, a length of between about two and ten inches, and a width of between about one and five inches, each base weight plate comprising at least one attachment means for removably attaching each base weight plate to an upper portion of the shoe;

(b) up to twenty removable, unitary, stackable intermediate weight plates, each intermediate weight plate having an identical, pre-determined weight of between about 0.1 and about five pounds, each intermediate weight plate having a bottom face and a top face;

(c) two removable cover plates or straps, one on the inner, medial side of the shoe upper, and the other fitting on an outer, lateral side of the shoe upper; and (d) an instep/back strap attached to the two cover plates or cover straps, the strap fitting under a shoe instep or along the back of the shoe when the weight assembly is in use.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
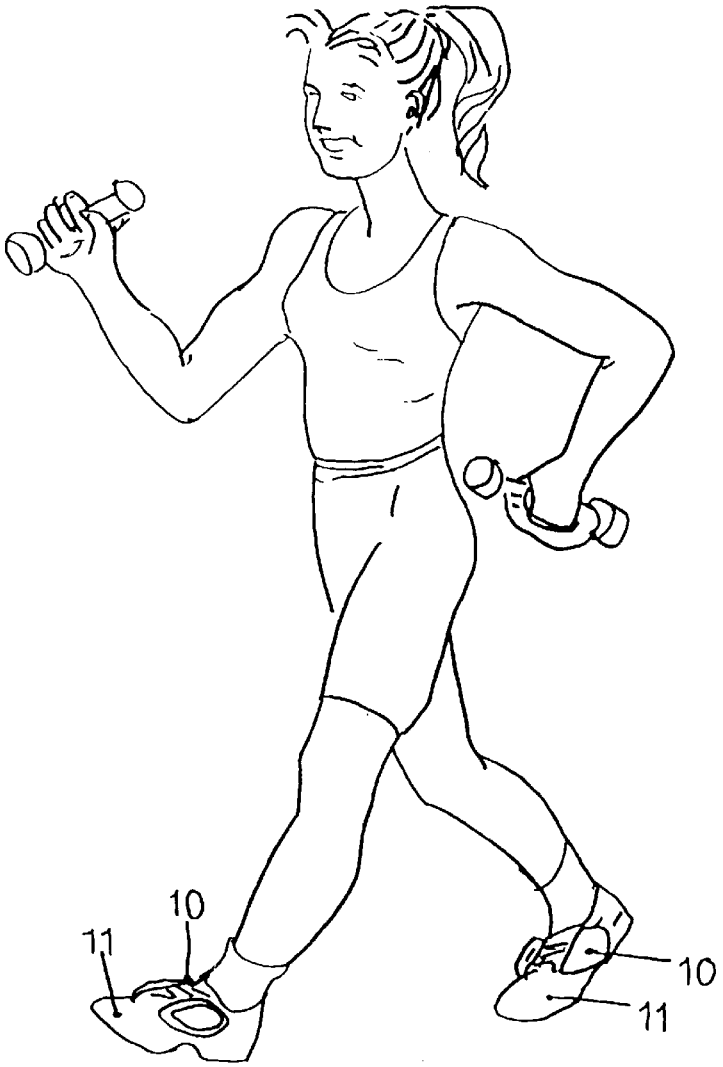
FIG. 1 shows a perspective view of a person wearing athletic shoes with removable weight assemblies according to the present invention.

In the following description, like reference characters designate like or corresponding parts throughout the several views. Also, in the following description, it is to be understood that such terms as "front," "back," within," and the like are words of convenience and are not to be construed as limiting terms. Referring in more detail to the drawings, the invention will now be described.

Referring to FIG. 1, a removable weight assembly 10 according to the present invention is shown on an athletic shoe 11. By "athletic shoe" is meant any shoe used for exercise or sports, including running shoes, walking shoes, aerobic shoes, jogging shoes, tennis shoes, basketball shoes, soccer shoes, golf shoes, and baseball shoes. This weight assembly is for use on casual exercise shoes as well as shoes used for professional sports training. Shoes for use with the present invention may be high topped (i.e., the top of the shoe covers the ankle) or low cut (i.e., the top of the shoe falls just below the ankle). This weight assembly can be used on store-bought athletic shoes without having to modify the shoe itself. It is not necessary to secure snap members, hooks or eyes, or studs on a shoe in order to use the present invention on the shoe. It is also not necessary to weave the weights into the shoe laces on the shoe. This is not an athletic shoe with an integral (built in) weight system.

Figure 2:
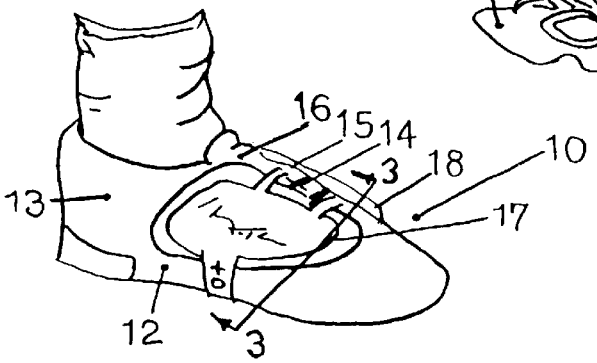
FIG. 2 is a perspective view of an athletic shoe with a weight assembly according to the present invention.

Athletic shoes 11 which may be used in association with the present invention are standard; they generally have a pre-formed, cushioned, unitary sole-heel base structure 12, and an upper structure 13 extending from the base structure with a vamp as shown in FIG. 2. The upper structure 13 of the athletic shoe has a vamp 14 with a shoe lace 15 that ties over a tongue 16. The weight assembly 10 can also be modified to fit over hook and loop (flexible tape) fasteners such as those which are on tennis shoes currently popular among schoolchildren. These hook and loop fasteners fasten over the tongue of the shoe at the vamp of the shoe's upper structure. Hook and loop fasteners are used in place of or in addition to standard-type laces. The weight assembly of the present invention is suitable for use on any athletic shoe with a vamp, including men's, women's and children's styles. It could be sold as a kit with a pair of athletic shoes, or sold separately for use on existing shoes. Generally, two weight assemblies would be sold in a package for use on a commercially available pair of shoes.

Referring to FIG. 2, the present weight assembly is in two portions: one portion 17 fits on the outside, or lateral side, of the shoe, and the other, mirror-image portion 18 is removably affixed to the inside, or medial side, of the shoe. One portion may be worn without the other, as would occur in the treatment of certain ankle and knee pathologies.

Figure 3:
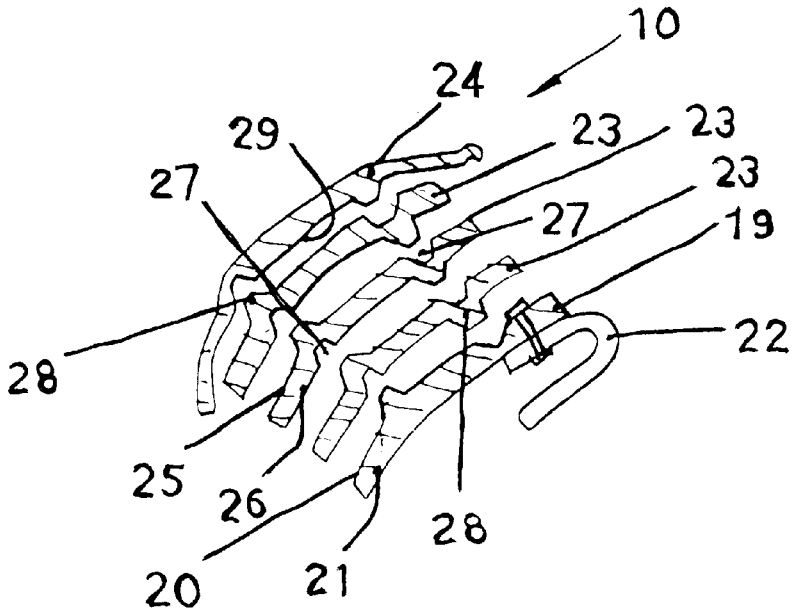
FIG. 3 is a cross-sectional view of a part of a weight assembly according to the present invention.
Figure 4:
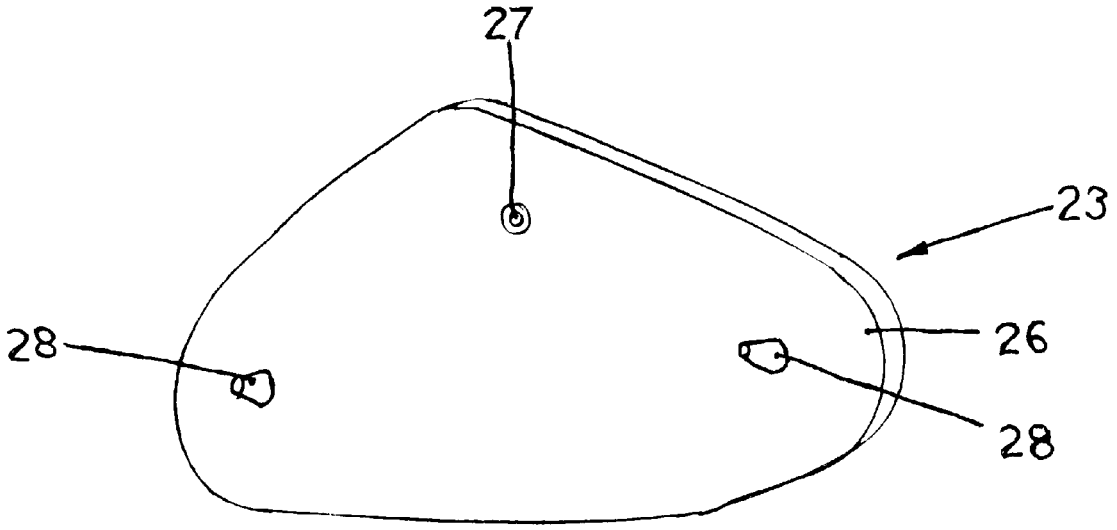
FIG. 4 is a perspective view of an intermediate weight plate of the weight assembly of FIG. 3.

FIG. 3 is a cross-section taken across line 3—3 in FIG. 2. Each weight assembly 10 comprises two similar, removable, unitary base weight plates 19. Each base weight plate 19 has a pre-determined weight of between about 0.1 and about five pounds, preferably 0.25 or 0.33 pounds. Each base weight plate 19 is relatively flat and generally triangular or kidney-shaped, with a top face 20 and a bottom face 21 as set forth in FIG. 3. Each base weight plate 19 comprises means for removably attaching the base weight plate to a vamp of the shoe. The preferred means for removably attaching the base weight plate 19 are between one and five base hooks 22. Each base hook 22 projects downwardly from an upper extremity of the bottom face 21 of the base weight plate, and is capable of hooking over an outside edge of the vamp 14 of the shoe 11. Each of the two parts 17, 18 of the weight assembly 10 comprises one base weight plate 19, preferably with two base hooks 22 secured to the bottom face.

As is shown in FIG. 3, each weight assembly 10 further comprises: up to twenty removable, unitary intermediate weight plates 23, each intermediate weight plate 23 having an identical, pre-determined weight of between about 0.1 and about five pounds, preferably 0.25 or 0.33 pounds. The weight plates in each weight assembly preferably all weigh the same as each other. Each weight assembly 10 further comprises: two removable covers plates 24, or two or more cover straps. The cover plate 24 at least partially extends over and holds the weight plates underneath. The cover plate 24 preferably does not extend down around the sides of the weight plates, since the number of weight plates varies and it is advantageous for the weight plates to be visible to the user for recalling the weight amount.

By "unitary" is meant that each weight plate is one piece. This facilitates quick addition or subtraction of the weight plates just prior to use. The user can also pause during exercise to add or subtract an intermediate weight plate in order to increase or decrease the amount of weight being carried on each foot.

This weight assembly can be put on store-bought athletic shoes without having to modify the shoe itself These weight plates fit on the curve of top of shoe/foot because of their shape. They generally do not bounce around during running or inhibit movement of the feet during exercise. With the present assembly, weight is distributed in good location on foot; weight does not unduly stress user's ankle or foot. Gain without pain can be accomplished. In other words, proper use during regular, consistent exercise commonly results in gradual build-up of the muscle mass of the legs. This can be accomplished with a lowered incidence of tendonitis and other exercise injuries to the foot, ankle, leg, knee, or hips, which are often associated with using ankle or shoe weights during exercise.

Each intermediate weight plate 23 also has a top face 25 and a bottom face 26. On the top face 20 of the base weight plate 19, and the top and bottom faces of the intermediate base plates 23, are preferably small indentations 27 and/or nodes 28 in the weight plate itself. By "node" is meant a small post, bump, elevation or nodule. By "indentation" is meant a small depression or valley.

Figure 5:
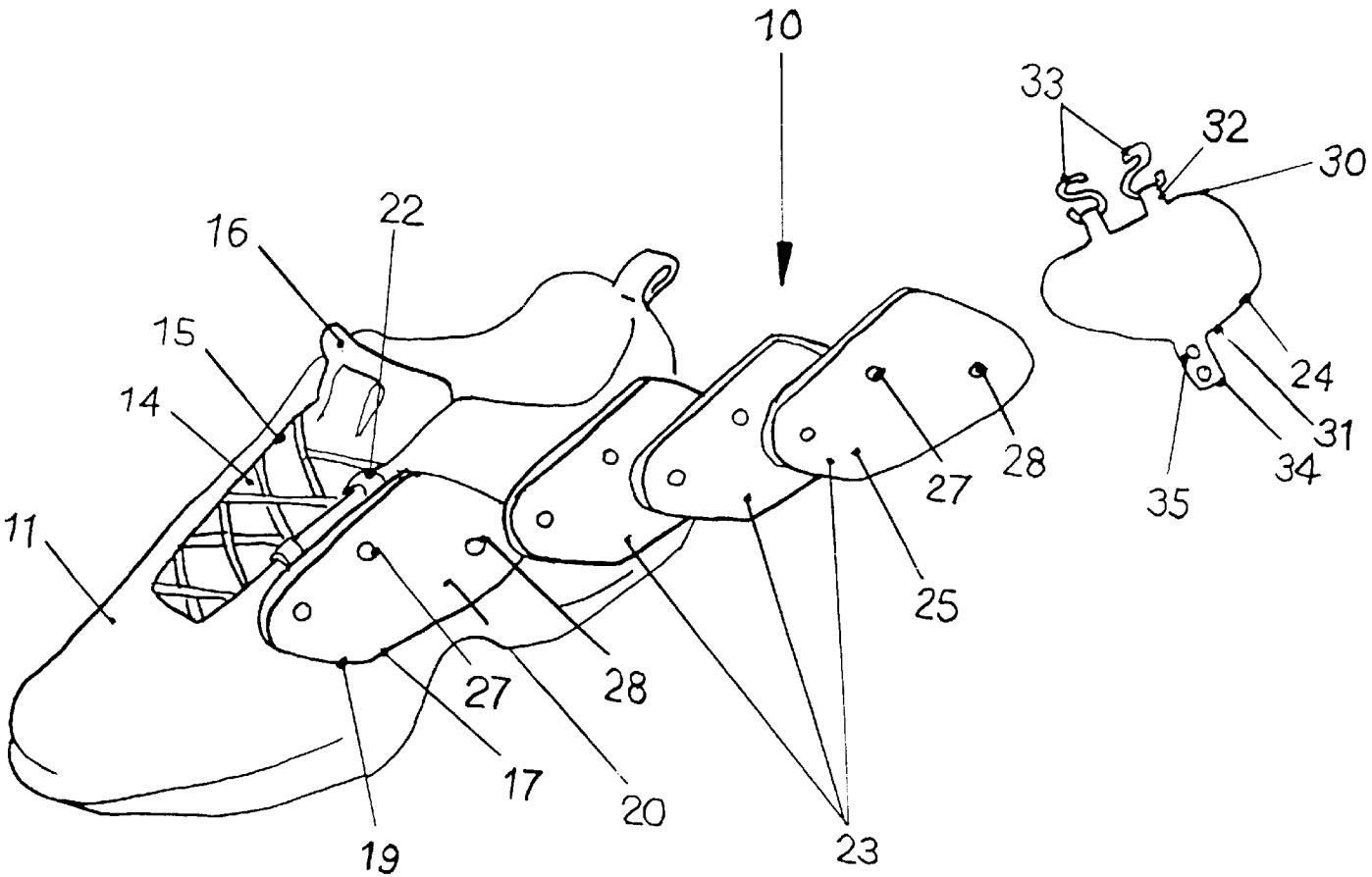
FIG. 5 is a perspective view of an athletic shoe with a weight assembly according to the present assembly, with weight plates and the cover shown detached.

Referring to FIG. 5, the outside part 17 of the embodiment shown is the portion that fits on the outside side of the shoe. Each part includes: a base weight plate 19, optional intermediate weight plates 23, and an assembly cover 24. This part 17 of the weight assembly 10 fits along the outside edge of the shoe vamp 14.

In use, each base weight plate 19 is hooked on or otherwise attached to an edge of the vamp 14 of the shoe 11 as shown in FIG. 5. Ordinarily, two base hooks 22 on the base weight plate are slipped over the edge of the vamp between the shoe laces 15. The ends of the base hooks 22 preferably contact the tongue 16 rather than the person's foot in the shoe, so they are not uncomfortable.

The indentations 27 and nodes 28 on the top face 20 of the base weight plate 19 fit into (correspond to) indentations 27 and nodes 28 in the bottom faces 26 of any of the three intermediate weight plates 23, as shown in FIG. 5. The indentations 27 and nodes 28 on the top faces 25 of the intermediate weight plates 23 fit into (correspond to) indentations 27 and nodes 28 in the bottom faces of the other intermediate weight plates in the set. The intermediate weight plates 23 are thus interchangeable. The indentations 27 and nodes 28 on the top faces 25 of the intermediate weight plates 23 also fit into (correspond to) indentations 27 and nodes 28 in the bottom face 29 of the cover 24 as shown in FIGS. 5 and 3. The indentations 27 and nodes 28 on the bottom face 29 of the cover 24 also fit into (correspond to) indentations 27 and nodes 28 in the top face 29 of the base weight plate 19 in case the user just wants to carry a small amount of weight on each foot (i.e. without intermediate weight plates).

In an alternate embodiment, the weight plates clasp onto each other by magnetic attraction, so that indentations and nodes are not required. Indentations and nodes on the weight plates are preferred but not required herein. Various other means of keeping the weight plates stacked within the two parts of the assembly are also included herein.

These weight plates are preferably made of a relatively flexible, material like natural or synthetic rubber, or polyvinylchloride. Preferred materials for use herein are Fiberglas reinforced rubber, latex rubber, polycarbonite, and polyvinylchloride. The weight plates of the present assembly are most preferably substantially comprised of iron and/or copper impregnated polyvinylchloride (PVC). This material is highly desirable for use herein because a high amount of weight can be packed into a small, area. Thus, the weights are not bulky, are somewhat conformable to the shape of the shoe, fit on the shoe, and are easy for the user to handle. Weight plates made of this material are also advantageous in that they are easy to clean, even after shoes bearing this weight assembly have been over muddy or dirty turf. Hooks and buckles of the present assembly are preferably made of brass and/or plastic.

As set forth in FIG. 5, each relatively flat assembly cover 24 has an upper, vamp side 30 and a lower, opposite, sole side 31. In the cover embodiment shown in FIG. 5, two separate short straps 32 are attached to the bottom face 29 of the cover 24 on its vamp side 30. Each vamp strap 32 is attached to a vamp hook 33. When the weight assembly 10 is in place on the athletic shoe, the hooks 33 fit over the shoe laces 15. Although S-shaped hooks 33 on vamp straps 32 are shown, other types of hooks, snaps or fasteners may be employed, with or without straps. The vamp hooks 33 may alternatively fit over the edge of the vamp 14 between the laces 15. On the opposite, sole side 31 of the cover 24 is an attached sole strap 34. The attached strap 34 has one or more central perforations 35.

Figure 6:
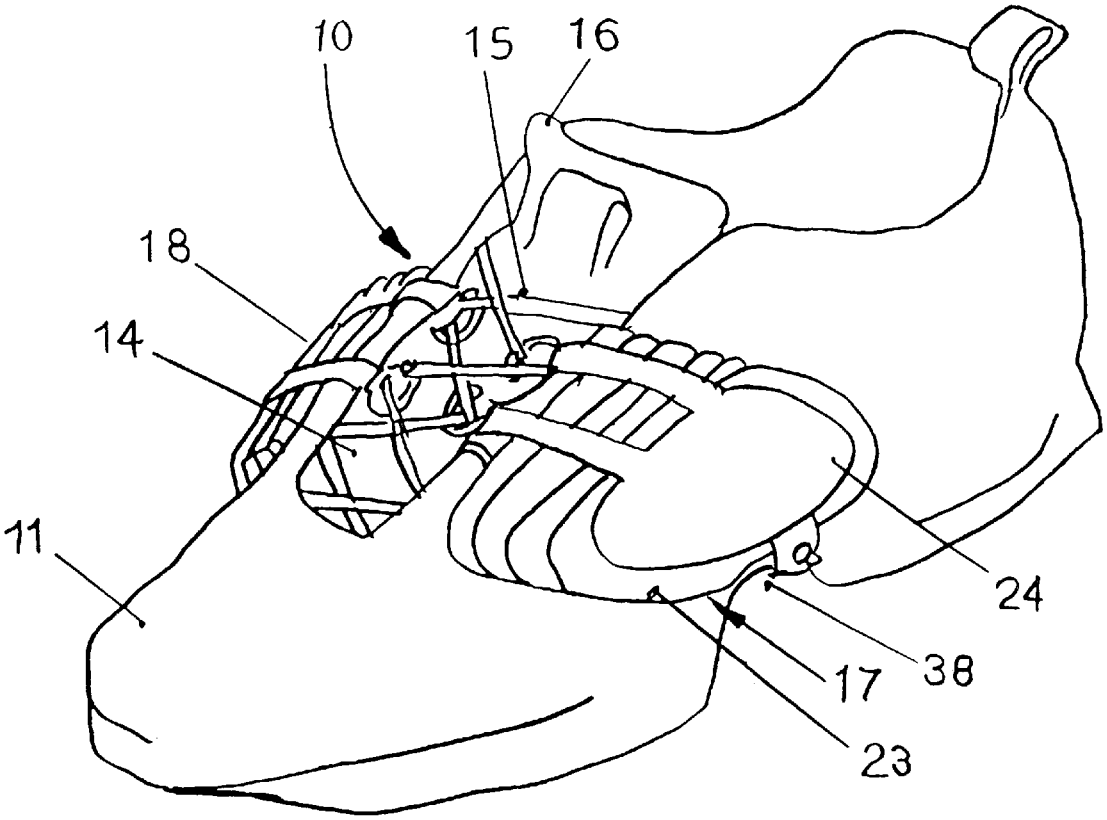
FIG. 6 is a perspective view of an athletic shoe with a weight assembly according to the present invention.

Referring to FIG. 6, a weight assembly 10 is shown in place on an athletic shoe 11. One part 17 of the assembly 10 is removably secured to the outside of the shoe and one part 18 is removably secured to the inside of the shoe 11. A logo or slogan can be written on the cover 24. The embodiment shown in FIG. 6 holds a number of intermediate weight plates 23 in each part 17, 18. In the cover embodiment shown, the cover vamp hooks 33 are S-shaped so that they can easily be hooked over several loops of the shoe laces 15 as shown in FIG. 6. The cover 24 is preferably made of leather, which is flexible, strong, and easily cleaned.

Figure 7:
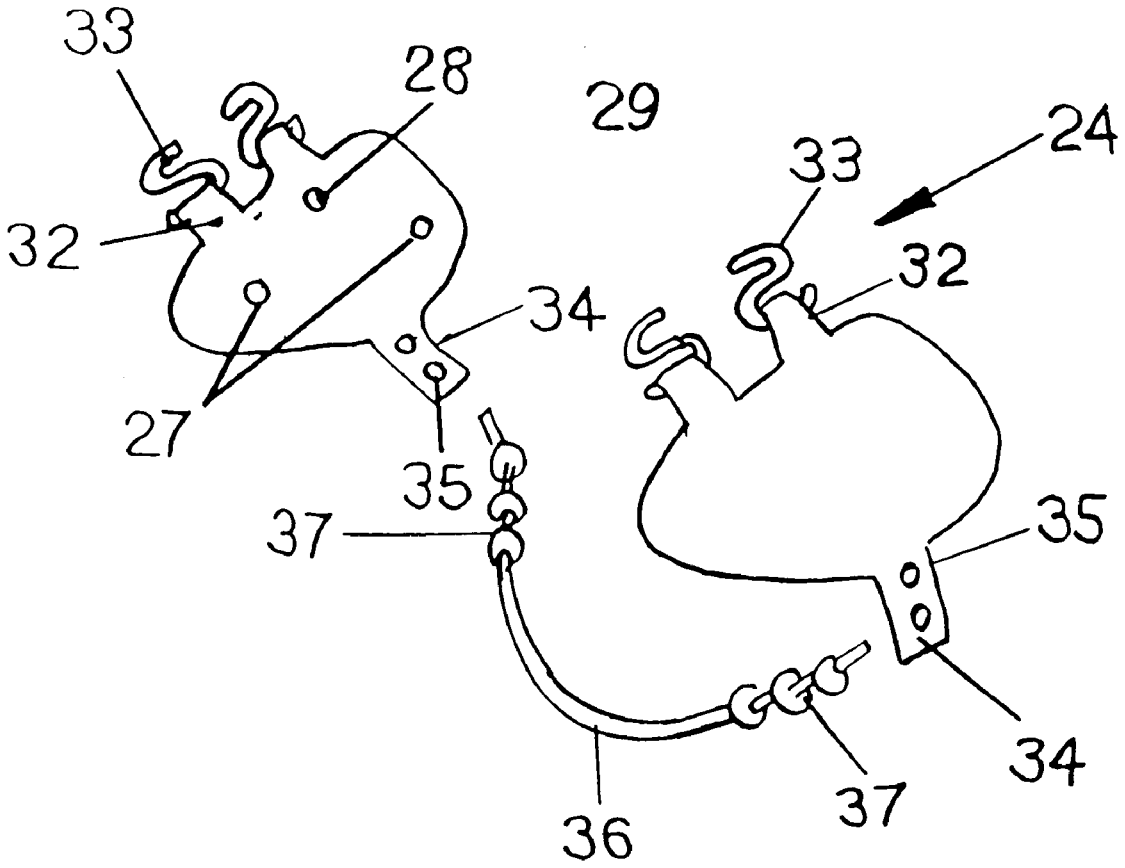
FIG. 7 is a perspective view of the assembly cover of the weight assembly of FIG. 5.

FIG. 7 sets forth the assembly cover 24 of the weight assembly 10. The two sections of the cover 24 are shown open, or detached from the remainder of the weight assembly. In FIG. 7, one section of the cover 24 is shown from the top and one section from the bottom. Two sturdy vamp straps 32, which are preferably expandable, and vamp hooks 33 extend from each cover 24 on the vamp side 30. Once both parts of the cover 24 are in place on the shoe over the uppermost intermediate weight plates 23, or the base weight plates 19 in the case where no intermediate weight plates are used, an expandable instep strap 36 is removably attached to the sole straps 34 of each part of the cover 24. The instep strap 36 has one or more knots 37, or enlargements, on each of its opposite ends.

To attach the cover 24 to the weight assembly, one end of the instep strap 36 is placed through a perforation 35 in the sole strap 34 of one part of the cover 24 so that the knot 37 extends through the perforation 35. The instep strap 36 is then placed under the instep 38 (sole) of the shoe 11 and stretched to the other side of the shoe. Placing the instep straps 36 under the instep is advantageous because the straps will not be worn by the repeated contacts of the soles of the shoes on the ground or floor during exercise. On the opposite side of the shoe, the user inserts a knot 37 on the opposite end of the instep strap 36 through one of the tight perforations 35 in the sole strap 34. The user can then pull the free end of the instep strap 36 until the next knot 37 in line is pulled through the perforation 35. This tightens the cover over the weight plates. Thus, the assembly 10 is secured on the shoe. This is repeated for the other shoe.

After exercising, the user reverses the process with the shoe on (preferably) or off the foot. To remove the assembly 10 from each shoe, the user unfastens the cover sole straps 34 from the ends of the instep strap 36, unhooks the cover vamp hooks 33 from the shoe laces, and removes the two sections of the cover 24. The user then lifts off the intermediate weight plates 23, and then unhooks the base weight plate 19 from the shoe vamp. These parts of the weight assembly are stored until the next use.

The weight assembly 10 is versatile enough to allow the user to pause during exercise to add intermediate weight plates 23. Each section of the assembly cover 24 can be lifted up slightly, particularly if the cover vamp straps 32 are expandable, and the intermediate weight plate(s) can be slipped in under the cover 24. This is believed to be a novel option. It allows the user the option of adding or subtracting increments of weight during a workout without a long pause in the exercise program. This could be because the user decides after exercising a while that he or she could use more or less weight, or because he or she has switched to a different type of exercise where more or less weight is appropriate, or because the user is using the weight assembly for pre-competition myofiber recruitment and warm-up.

Figure 8:
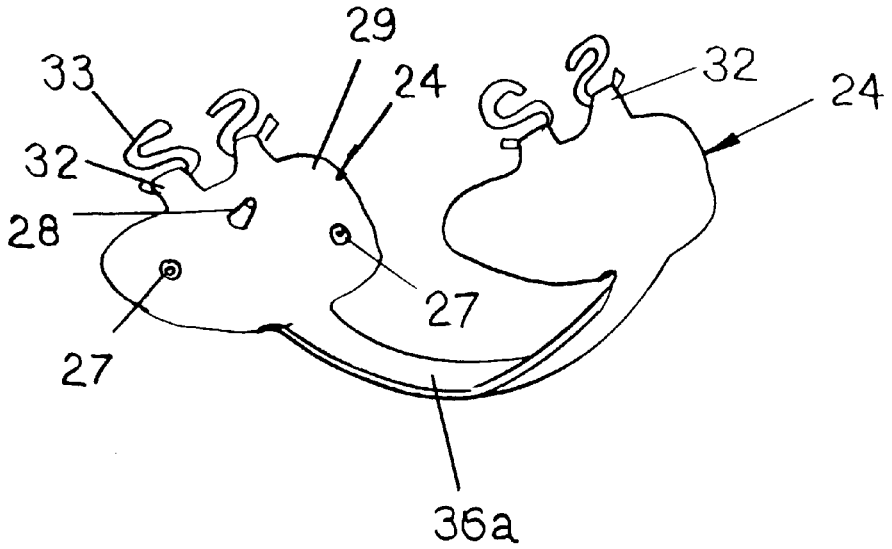
FIG. 8 is a perspective view of an alternate embodiment of an assembly cover of a weight assembly according to the present invention.

FIG. 8 sets forth an alternate embodiment of an assembly cover 24 of a weight assembly 10. The parts of the cover 24 are attached to each other by an expandable instep strap 36*a*. The instep strap 36*a* of the one-piece cover 24 is placed under the shoe instep 38. Since the instep strap is expandable, it fits across small or large shoe widths. Once the desired number of intermediate weight plates 23 are in place, each side of the cover 24 is placed over the uppermost intermediate weight plate 23 so that the indentations 27 on the bottom of the cover match up with the nodes 28 on the uppermost intermediate weight plate 33, and the nodes 28 on the bottom of the cover match up with the indentations 27 on the uppermost intermediate weight plate. It takes only a minute for the user to place the sides of the cover 24 on top of the plates 23. The vamp sides 30 of the parts of the cover are then stretched toward the shoe vamp 14, and the cover vamp hooks 33 on both sides of the vamp are hooked over the shoe laces 15. The instep strap 36*a* need not be fitted on the shoe each time as is the case with the detachable instep strap 36 shown in FIG. 7.

Figure 9:
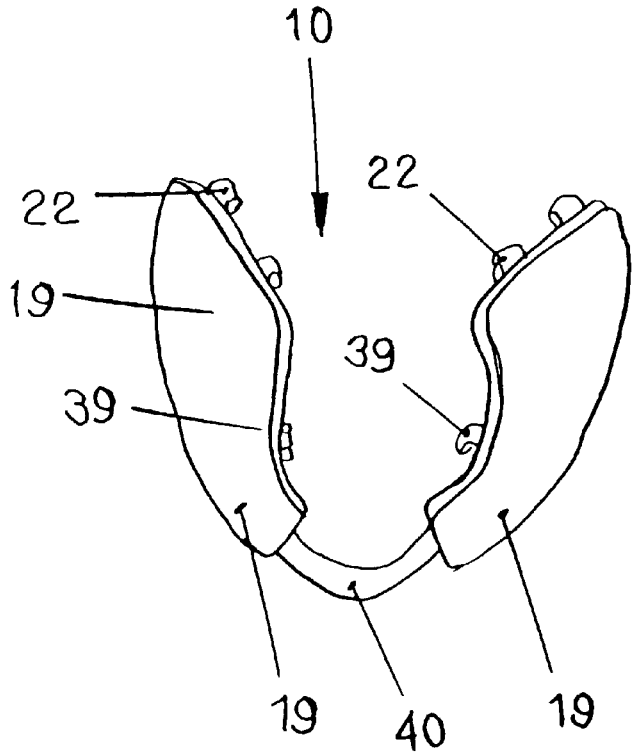
FIG. 9 is a perspective view of an alternate embodiment of a weight assembly according to the present invention.

Referring to FIG. 9, an alternate embodiment of a weight assembly according to the present invention is shown. Rather than multiple weight plates held in place on an athletic shoe by a cover plate, the weight assembly for each shoe here has two base weight plates 19. The base weight plates 19 are held in place on the shoe by base hooks 22, side hooks 39, and a back upper strap 40. Each base weight plate is slightly longer than the embodiments shown in previous figures and the plate is somewhat heavier. Each of these base weight plates extends back across the shoe upper under the wearer's ankle.

Figure 10:
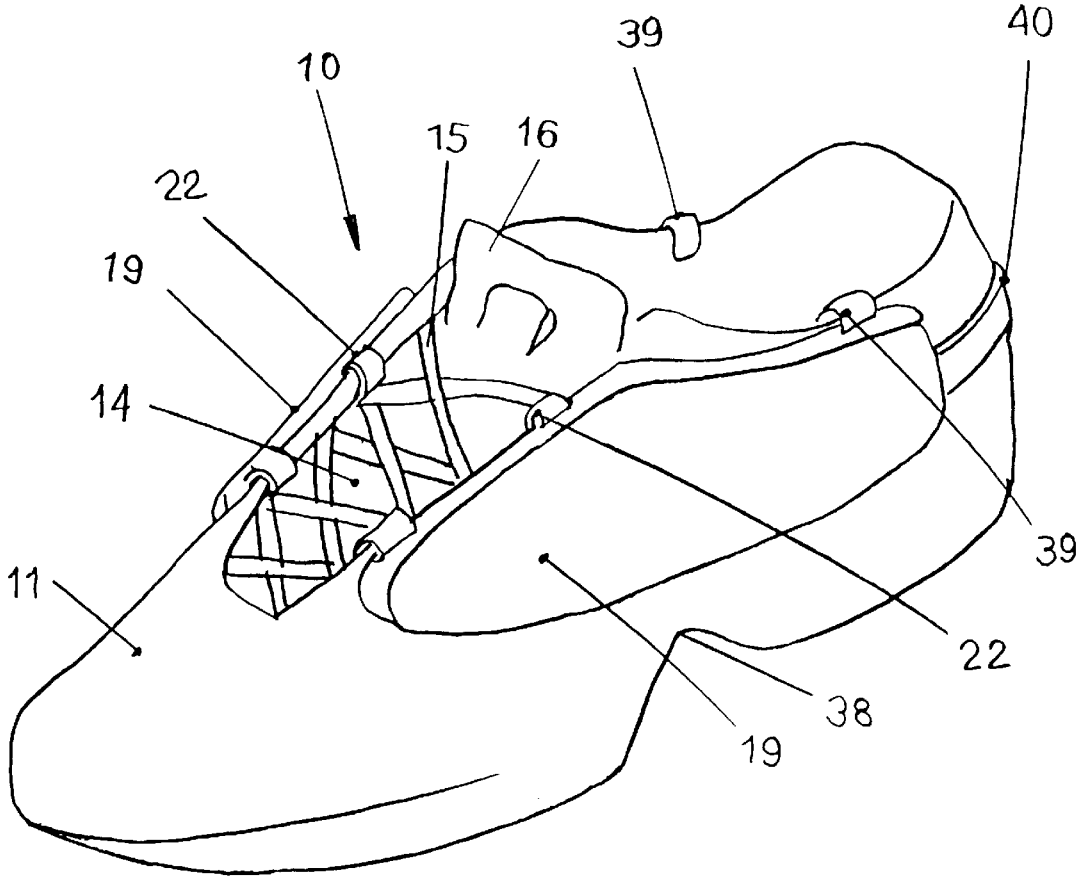
FIG. 10 is a perspective view of the weight assembly according to FIG. 9 in place on an athletic shoe.

As shown in FIG. 10, the base hooks 22 removably attach the base weight plate 19 over the shoe vamp 14, and the side hooks 39 removably attach the weight plates 19 to the top of the shoe just under the ankle. The back upper strap 40 connects the two base weight plates 19 to each other at their rear across the upper portion of the shoe in the back. The back upper strap 40 may be made of leather, elastic or any other suitable material. Since there are no intermediate plates employed here, there are no nodes or indentations on the weight plates.

Figure 11:
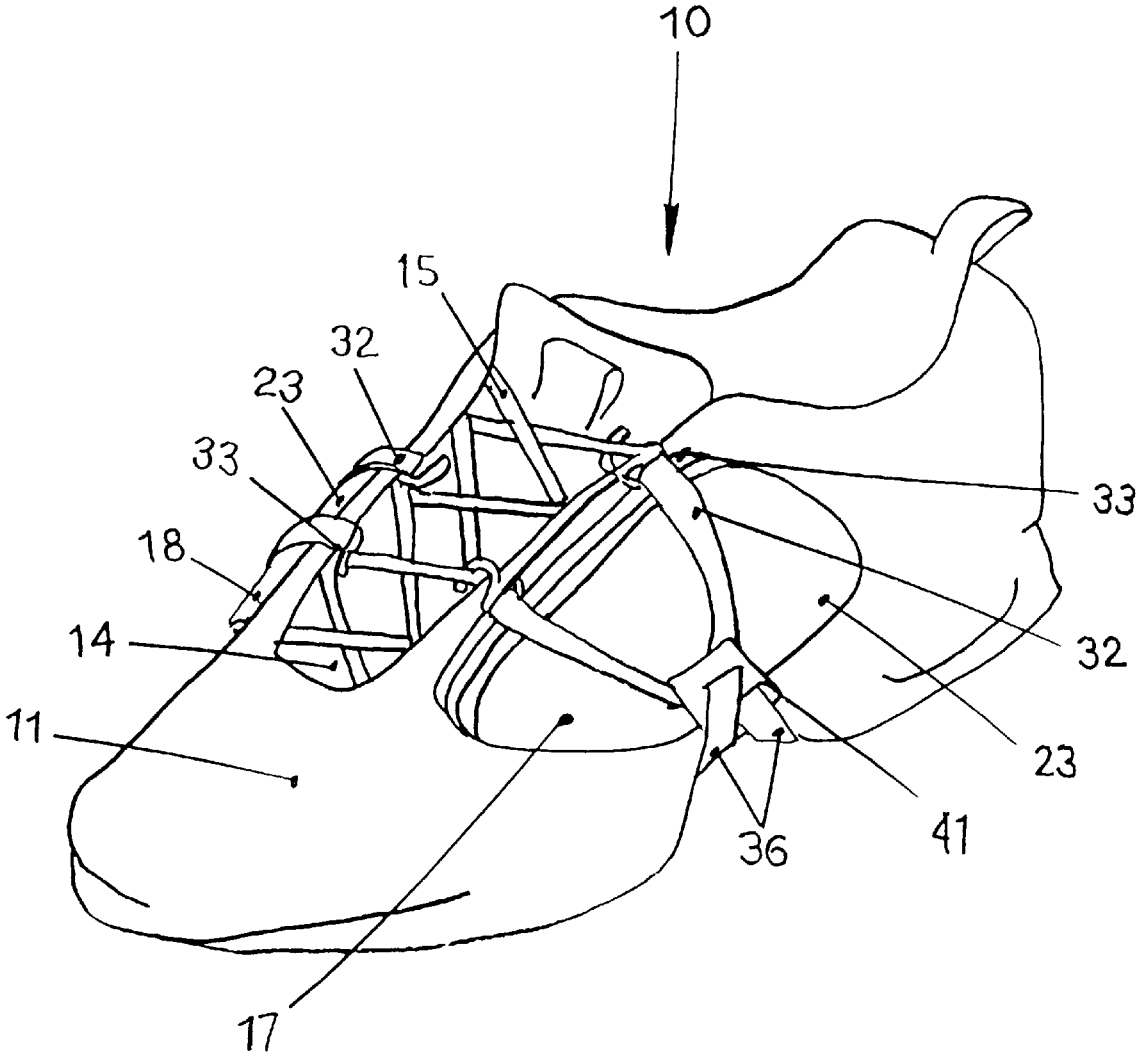
FIG. 11 is a perspective view of an alternate embodiment of a weight assembly according to the present invention on an athletic shoe.

As set forth in FIG. 11, an alternate embodiment of a weight assembly according to the present invention has cover straps in place of a cover plate. As in a previous embodiment, cover vamp hooks 33 removably attach the weight assembly 10 to the shoe laces 15 across the shoe vamp 14. Each cover vamp hook 14 is attached to a cover strap 32. Here, the cover straps 32 are longer and themselves act as a cover plate would in helping to hold the weight assembly on the shoe. Each cover strap 32 extends across the uppermost weight plate 23 and is connected to or contiguous with an instep strap 36. When the assembly is in use, the instep strap 36 fits under the shoe instep 38 and connects the inside and outside parts of the weight assembly. As shown in FIG. 11, a strap fastener hook 41 includes two or three slits through which an end of the instep strap 36 is threaded. The instep strap 36, which is preferably elasticized, can be adjusted for different shoe widths or different numbers and sizes of weight plates by tightening or loosening the end of the instep strap. The inside part (not shown) of the weight assembly closely resembles the outside part (shown).

To use, once the weight plates are in place, the S-shaped cover vamp hooks 33 are applied around the shoe laces as shown in FIG. 11. The instep strap 36 is placed under the shoe instep and the strap fastener hooks 41 on either end of the instep strap are hooked onto the U-shaped cover straps on each side of the weight assembly. This pulls the cover straps 32 and the instep strap 36 taut, which holds down the weight plates on either side. Base hooks 22 extending from the base weight plates 19 over the shoe vamps 14 as shown in FIG. 10 are an optional alternative for this embodiment.

Because the present weight assembly generates increased resistance to both acceleration and deceleration, every movement of the legs generates increased demand for muscular activity to counter that increased resistance. Muscle tissue consists of millions of fibers that contract on demand. The greater the demand, the more muscle fibers are required to meet that demand. The increased demand is called recruitment, and it continues until demand is met. Once demand is met, the muscle becomes used to performing at a higher level of demand. This is called accommodation. It can occur over time, and results in improved muscular strength and endurance. This may occur over a relatively short time, such as warm ups prior to athletic competition, and can result in a dramatic increase in muscular performance. Thus, the present weight assembly is believed to give the athlete trained with this weight assembly a significant advantage.

Another advantage of the present weight assembly is that the weights are distributed both medially and laterally to the midline of the foot, and the amount of weight placed can differ from medial to lateral. This assembly may therefore prove useful in the treatment of numerous ankle and knee pathologies that arise from malformations, weakness of specific soft tissues, and trauma. This assembly may be helpful for reducing a tendency toward excessive pronation or supination of the ankle; a mal-alignment is often responsible for increasing the risk of injuries including ankle sprains, fractures, and knee cruciate or collateral ligament tears or varus and valgus deformities.

From the foregoing it can be realized that the described device of the present invention may be easily and conveniently utilized. While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

What is claimed is:

1. An adjustable, removable weight assembly for an athletic shoe, the weight assembly comprising:

(a) a pair of removable, unitary base weight plates, each base weight plate having a pre-determined weight, each base weight plate having a top face and a bottom face, each base weight plate comprising at least one attachment means for removably attaching each base weight plate to a respective side of an upper portion of a shoe;

(b) a plurality of removable, unitary intermediate weight plates for stacking on the base weight plates, each intermediate weight plate having a pre-determined weight, each intermediate weight plate having a bottom face and a top face;

(c) two removable cover plates or straps, for fitting over the uppermost weight plate and retaining the intermediate weight plates on the base weight plates; and (d) an instep strap attached to the two cover plates or cover straps, the instep strap fitting under a shoe instep when the weight assembly is in use.

2. A weight assembly according to claim 1, wherein the attachment means for each base weight plate is between one and five hooks, each hook projecting downwardly from an upper extremity of the bottom face of the base weight plate, each hook being capable of hooking over an outside edge of the vamp of a shoe.

3. A weight assembly according to claim 1, wherein the base or intermediate weight plates further comprise a plurality of indentations or nodes on a bottom or top face of the plate, the nodes on the bottom face of a weight plate fitting into indentations on the top face of a weight plate underneath.

4. weight assembly according to claim 3, wherein the weight plates are substantially comprised of iron or copper impregnated polyvinylchloride.

5. A weight assembly according to claim 4, wherein cover plates at least partially cover and hold the weight plates on each side of a shoe.

6. A weight assembly according to claim 5, wherein the weight assembly further comprises an elasticized instep strap, the instep strap having attachment means on each end for attaching one end of the instep strap to each cover plate.

7. A weight assembly according to claim 5 for use on an athletic shoe with shoe laces along a vamp, wherein the cover plates have one or more hooks on one side of each cover plate for removable attachment of the cover plates during use to the shoe laces along the shoe vamp, with one cover plate on each side of the vamp.

8. A weight assembly according to claim 4, wherein the weight assembly comprises one or two removable cover straps which fit over and hold the weight plates on each side of a shoe.

9. A weight assembly according to claim 8, wherein each weight assembly comprises:

from about one to about five intermediate weight plates stacked on each base weight plate; and a cover strap over each stack of weight plates, the cover straps being connected to an elasticized instep strap, the instep strap fitting under a shoe instep.

10. A weight assembly kit according to claim 1, comprising two sets of weight assemblies for a pair of shoes.

* * * * *